US012760923B2

(12) United States Patent
Hattori et al.

(10) Patent No.: US 12,760,923 B2
(45) Date of Patent: Oct. 13, 2026

(54) VENTILATION SYSTEM AND BUILDING EQUIPPED WITH VENTILATION SYSTEM

(71) Applicants: Panasonic Holdings Corporation, Osaka (JP); SEKISUI HOUSE, LTD., Osaka (JP)

(72) Inventors: Shinya Hattori, Aichi (JP); Kunio Kiyomoto, Aichi (JP); Tomoyuki Higuchi, Aichi (JP); Takumi Tojo, Aichi (JP); Naoto Masamura, Aichi (JP); Toru Sasai, Aichi (JP); Susumu Urushihara, Osaka (JP); Kaori Tasato, Osaka (JP)

(73) Assignees: Panasonic Holdings Corporation, Osaka (JP); SEKISUI HOUSE, LTD., Osaka (JP)

( * ) Notice: Subject to any disclaimer, the term of this patent is extended or adjusted under 35 U.S.C. 154(b) by 529 days.

(21) Appl. No.: 18/021,919

(22) PCT Filed: Jul. 1, 2021

(86) PCT No.: PCT/JP2021/024970
§ 371 (c)(1),
(2) Date: Feb. 17, 2023

(87) PCT Pub. No.: WO2022/038906
PCT Pub. Date: Feb. 24, 2022

(65) Prior Publication Data

US 2023/0304694 A1 Sep. 28, 2023

(30) Foreign Application Priority Data

Aug. 21, 2020 (JP) ..... 2020-140393

(51) Int. Cl.
*F24F 11/79* (2018.01)
*F24F 7/10* (2006.01)
(Continued)

(52) U.S. Cl.
CPC ..... *F24F 11/79* (2018.01); *F24F 7/10* (2013.01); *F24F 11/0001* (2013.01); *F24F 11/63* (2018.01)

(58) Field of Classification Search
CPC ..... F24F 11/79; F24F 7/10; F24F 11/0001; F24F 11/63; F24F 7/08; F24F 2110/10;
(Continued)

(56) References Cited

U.S. PATENT DOCUMENTS 11,300,310 B2 * 4/2022 Gupta ..... F24F 11/50
11,692,728 B2 * 7/2023 Zhou ..... F24F 11/54 165/237
(Continued)

FOREIGN PATENT DOCUMENTS

JP 08-094123 A 4/1996
JP 2010-032099 A 2/2010
(Continued)

OTHER PUBLICATIONS

International Search Report issued in corresponding International Application No. PCT/JP2021/024970, dated Sep. 21, 2021, with English translation.

*Primary Examiner* — Kidest Worku
(74) *Attorney, Agent, or Firm* — Rimon P.C.

(57) ABSTRACT

A ventilation system according to a certain aspect includes: a ventilator that ventilates a first space; an air conveyor that is installed on a ceiling surface of the first space and conveys air from the first space to a second space different from the first space; a controller that controls an operation of the ventilator and an operation of the air conveyor; a first temperature measurer that measures an air temperature of the first space; and a second temperature measurer that measures an air temperature of the second space. The controller includes a determiner that determines whether the air conveyance by the air conveyor is possible or impossible
(Continued)

on the basis of an air temperature of the first space and an air temperature of the second space.

9 Claims, 10 Drawing Sheets

(51) Int. Cl.
*F24F 11/00* (2018.01)
*F24F 11/63* (2018.01)

(58) Field of Classification Search
CPC ..... F24F 12/001; F24F 7/007; F24F 11/74; Y02B 30/56; Y02B 30/70
See application file for complete search history.

(56) References Cited

U.S. PATENT DOCUMENTS

2004/0237571 A1* 12/2004 Choi ..... F24F 1/0073 62/412
2014/0112781 A1* 4/2014 Yang ..... F21V 21/04 416/5
2019/0072288 A1* 3/2019 Niemiec ..... E04B 9/02
2019/0170375 A1* 6/2019 Poerschke ..... F24F 3/044

FOREIGN PATENT DOCUMENTS

JP 2011-127845 A 6/2011
JP 5235098 B2 * 7/2013
JP 201640504 A1 * 3/2016
JP 2018-112352 A 7/2018
WO 2015189899 A1 12/2015
WO WO2019058516 A * 3/2019

* cited by examiner

VENTILATION SYSTEM AND BUILDING EQUIPPED WITH VENTILATION SYSTEM

CROSS-REFERENCE TO RELATED APPLICATIONS

This application is the U.S. National Phase under 35 U.S.C. § 371 of International Patent Application No. PCT/JP2021/024970, filed on Jul. 1, 2021, which in turn claims the benefit of Japanese Patent Application No. 2020-140393, filed on Aug. 21, 2020, the entire content of each of which is incorporated herein by reference.

TECHNICAL FIELD

The present disclosure relates to a ventilation system and a building equipped with the ventilation system.

BACKGROUND ART

Patent Literature 1 describes an air conditioning system that simultaneously performs ventilation and air conditioning in a plurality of rooms. This air conditioning system is provided with an air conditioning room in which an air conditioner is disposed independently of a plurality of rooms, and includes an air supply duct that couples the air conditioning room and each room. The air in the air conditioning room that has been air-conditioned is individually distributed and supplied to each room via the air supply duct. Each room is simultaneously ventilated and air-conditioned by air supply and exhaust through an air supply port and an air exhaust port.

PRIOR ART DOCUMENT

Patent Literature

[Patent Literature 1] JP 2011-127845 A

SUMMARY OF INVENTION

Technical Problem

The present inventor has obtained the recognition described below regarding a ventilation system of a plurality of spaces of a building.

When air conditioning states such as temperature, humidity, and air quality in a plurality of spaces of a building are non-uniform, there is a possibility that the user moving from one space to another space feels discomfort. However, the air conditioning system of Patent Literature 1 has not been able to sufficiently cope with the alleviation of the non-uniformity of the air conditioning state of one space and another space.

The present disclosure has been made to solve the above-described problems, and an object is to provide a ventilation system capable of alleviating user's discomfort.

Solution to Problem

In order to solve the above-described problems, a ventilation system according to a certain aspect of the present invention includes: a ventilator that ventilates a first space; an air conveyor that is installed on a ceiling surface of the first space and conveys air from the first space to a second space different from the first space; an air conveyance path that communicates the first space with the second space and conveys air from the first space to the second space; a controller that controls an operation of the ventilator and an operation of the air conveyor; a first temperature measurer that measures an air temperature of the first space; and a second temperature measurer that measures an air temperature of the second space. The air conveyor includes a dust collector for collecting dust contained in air passing through the air conveyance path. The ventilator includes a heat exchange element for performing heat exchange between a supply air flow and an exhaust air flow. The controller includes a determiner that determines whether air conveyance from the first space to the second space by the air conveyor is possible or impossible on the basis of a first temperature measured by the first temperature measurer and a second temperature measured by the second temperature measurer.

Note that an aspect of the present disclosure in which the expression of the present disclosure is converted between a method, a device, a system, a recording medium, a computer program, and the like is also effective.

Advantageous Effects of Invention

According to the present disclosure, it is possible to provide a ventilation system capable of alleviating a user's discomfort.

DESCRIPTION OF EMBODIMENTS

Figure 1:
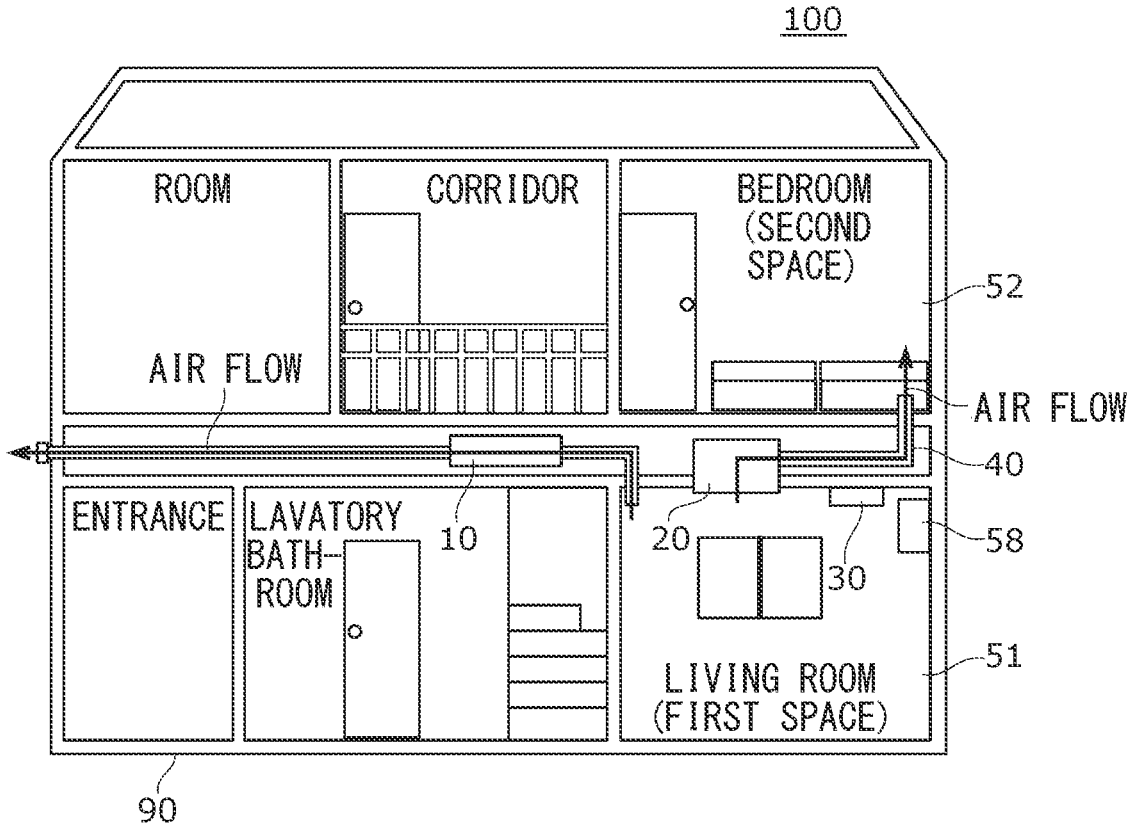
FIG. 1 is a schematic configuration diagram illustrating a ventilation system according to an example.

Hereinafter, modes for carrying out the present disclosure will be described with reference to the accompanying drawings. In examples and modifications, the same or equivalent components and members are denoted by the same reference numerals, and redundant description is omitted as appropriate. In addition, the dimensions of the members in each drawing are appropriately enlarged and reduced for the sake of easy understanding. In addition, in each drawing, some of the members that are not important for describing the examples are omitted.

In addition, terms including ordinal numbers such as first and second are used to describe various components, but the terms are used only for the purpose of distinguishing one component from other components, and the components are not limited by the terms.

Figure 2:
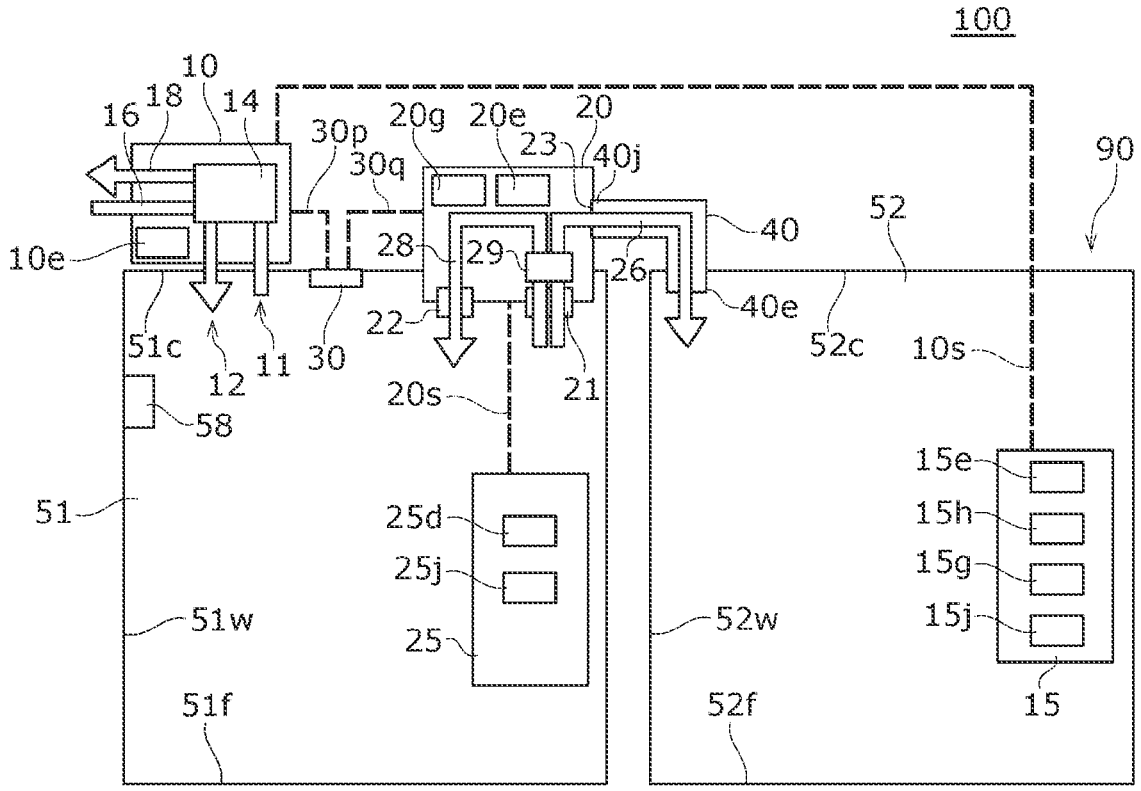
FIG. 2 is a functional block diagram schematically illustrating the ventilation system of FIG. 1.

An overall configuration of a ventilation system 100 according to an example of the present disclosure will be described with reference to FIGS. 1 and 2. FIG. 1 is a schematic configuration diagram illustrating the ventilation system 100 according to an example. FIG. 2 is a functional block diagram schematically illustrating the ventilation system 100. The ventilation system 100 can be suitably used for a house and a building other than a house such as a nursery school, a medical facility, or a nursing care facility. The ventilation system 100 of the present embodiment is provided in a house 90, which is an example of the building. The house 90 is a living place provided as a place where residents live a private life. The house 90 may have a living room and a bedroom as rooms. As an example, a first space 51 is a living room (1F), and a second space 52 is a bedroom (2F). Note that, in FIG. 2, the first space 51 and the second space 52 are illustrated side by side. In addition, although not illustrated, the house 90 may have spaces such as a toilet, a bathroom, a lavatory, a kitchen, a dressing room, stairs, and a corridor.

The ventilation system 100 includes a ventilator 10, an air conveyor 20, an air conveyance path 40, and a controller 30. The ventilator 10 ventilates the first space 51. The air conveyor 20 conveys air from the first space 51 to the second space 52 through the air conveyance path 40. The controller 30 controls the operations of the ventilator 10 and the air conveyor 20.

The first space 51 (living room) is a space defined by a floor surface 51*f*, a wall surface 51*w*, and a ceiling surface 51*c* and having predetermined airtightness and heat insulating properties. A window (not illustrated) may be provided on the wall surface 51*w*. On the ceiling surface 51*c* of the first space 51, an air exhaust port 11 and an air supply port 12 of the ventilator 10, and an air exhaust port 21 and an air supply port 22 of the air conveyor 20 are provided. In addition, the first space 51 is air-conditioned by an air conditioner 58 such as an air conditioner.

The second space 52 (bedroom) is a space defined by a floor surface 52*f*, a wall surface 52*w*, and a ceiling surface 52*c* and having predetermined airtightness and heat insulating properties. A window (not illustrated) may be provided on the wall surface 52*w*. A ventilator (not illustrated) or an air conditioner (not illustrated) may be provided in the second space 52.

Ventilator

Figure 3:
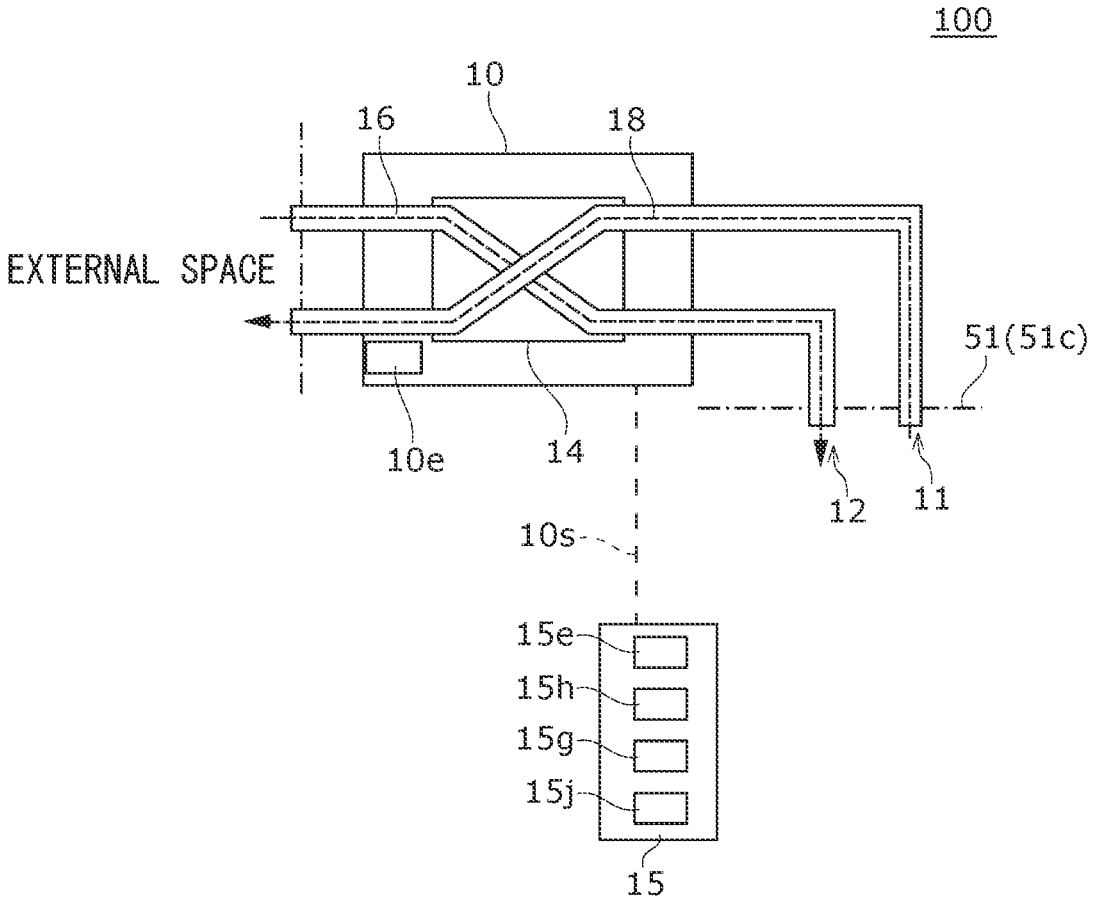
FIG. 3 is a schematic configuration diagram schematically illustrating a ventilator of FIG. 1.

The ventilator 10 will be described with reference to FIG. 3. FIG. 3 is a schematic configuration diagram schematically illustrating the ventilator 10. The ventilator 10 is installed on the ceiling surface 51*c* of the first space 51. The ventilator 10 includes an air blower (not illustrated) that generates a supply air flow 16 and an exhaust air flow 18. The supply air flow 16 is an air flow in which external air is supplied to the first space 51 through the air supply port 12 by the air blower. The exhaust air flow 18 is an air flow in which the internal air in the first space 51 is exhausted to an external space through the air exhaust port 11 by the air blower. The first space 51 is ventilated by the supply air flow 16 and the exhaust air flow 18. The ventilator 10 of the example is operated at the same time when the air conveyor 20 is operated. The ventilator 10 may also be operated when the operation of the air conveyor 20 is stopped.

The ventilator 10 includes a heat exchange element 14 for performing heat exchange between the supply air flow 16 and the exhaust air flow 18. In addition, the heat exchange element 14 may exchange humidity between the supply air flow 16 and the exhaust air flow 18. For example, when the temperature of the exhaust air flow 18 is lower than the temperature of the supply air flow 16 in the case of cooling the first space 51 such as during summer days, the temperature of the supply air flow 16 can be lowered by heat exchange between them, and a decrease in cooling efficiency due to ventilation can be suppressed. For example, when the temperature of the exhaust air flow 18 is higher than the temperature of the supply air flow 16 in the case of heating the first space 51 such as at night in winter, the temperature of the supply air flow 16 can be increased by heat exchange between them, and a decrease in heating efficiency due to ventilation can be suppressed.

The ventilator 10 of the example is configured to be remotely operable with a first remote controller 15 via a wired or wireless transmission path 10*s*. The first remote controller 15 is held on the wall surface 52*w* or the like of the second space 52. The first remote controller 15 includes a second temperature sensor 15*e*, a humidity sensor 15*h*, a second gas sensor 15*g*, and a second illuminance sensor 15*j*. The ventilator 10 is provided with a third temperature sensor 10*e*.

The second temperature sensor 15*e* exemplifies a second temperature measurer that measures the temperature of the air (air temperature) in the second space 52. The second illuminance sensor 15*j* exemplifies an illuminance measurer that measures the illuminance of the second space 52. The humidity sensor 15*h* measures the humidity of the second space 52. The second gas sensor 15*g* measures a gas concentration of a predetermined gas (for example, carbon dioxide) contained in the air in the second space 52. As the second gas sensor 15*g*, a sensor based on various principles can be adopted. The second gas sensor 15*g* of the example adopts a semiconductor gas sensor using tin oxide whose electric resistance changes due to a gas reduction action. The second gas sensor 15*g* exemplifies a second gas concentration measurer that measures the gas concentration of a predetermined gas contained in the air in the second space 52. The second illuminance sensor 15*j* measures the illuminance of the second space 52. The third temperature sensor 10*e* measures the outside air temperature. The measurement results of these sensors are used as environmental information for controlling the operation of the ventilation system 100.

Air Conveyor

Figure 4:
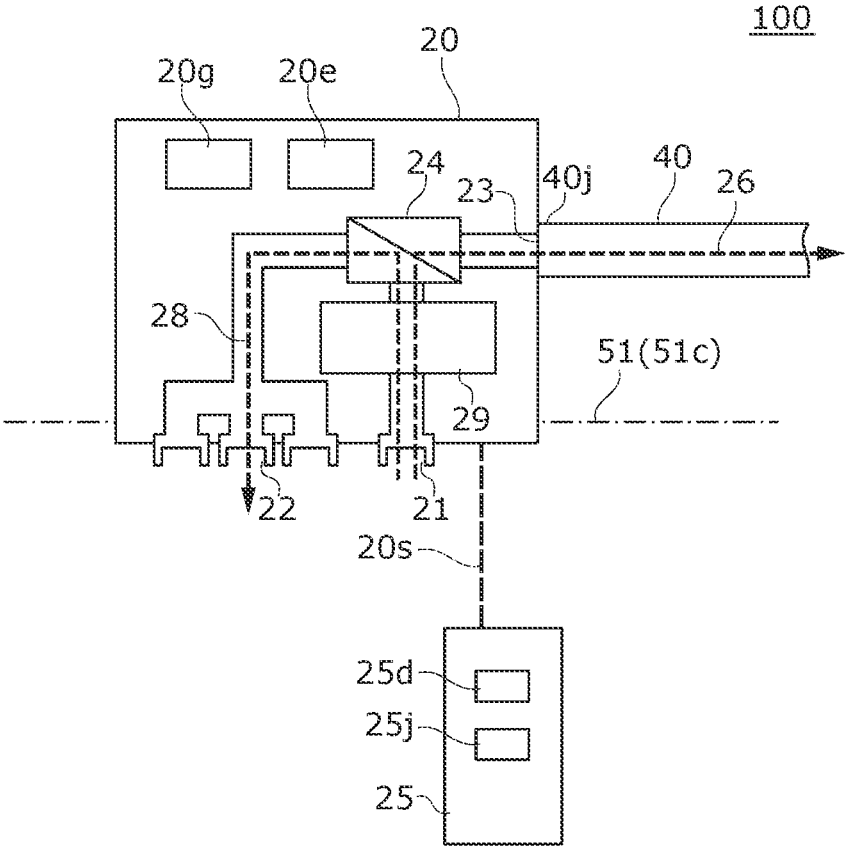
FIG. 4 is a schematic configuration diagram schematically illustrating an air conveyor of FIG. 1.

The air conveyor 20 will be described with reference to FIG. 4. FIG. 4 is a schematic configuration diagram schematically illustrating the air conveyor 20. The air conveyor 20 is installed on the ceiling surface 51*c* of the first space 51. The air conveyor 20 performs a conveyance operation of conveying air from the first space 51 to the second space 52 and a circulation operation of circulating air in the first space 51. The air conveyor 20 includes a blower unit (not illustrated) and a dust collector 29 for collecting dust. The air conveyor 20 generates a conveyance flow 26 using the blower unit during the conveyance operation, and generates a circulation flow 28 using the blower unit during the circulation operation. The air conveyor 20 includes a flow path switcher 24 that switches between the conveyance operation and the circulation operation.

The conveyance flow 26 is an air flow in which the internal air in the first space 51 is conveyed to the second space 52 by the blower unit through the dust collector 29, the flow path switcher 24, and the air conveyance path 40. The circulation flow 28 is an air flow in which the internal air in the first space 51 is circulated to the first space 51 by the blower unit through the dust collector 29 and the flow path switcher 24. In the conveyance flow 26 and the circulation flow 28, the air on the outlet side is clean air in which dust is reduced as compared with the air on the inlet side.

The air conveyor 20 is provided with a first temperature sensor 20*e* and a first gas sensor 20*g*. The first temperature sensor 20*e* measures the temperature of the air sucked from the first space 51. The first temperature sensor 20*e* exemplifies a first temperature measurer that measures the temperature of the air (air temperature) in the first space 51. The first gas sensor 20*g* measures a gas concentration of a predetermined gas (for example, carbon dioxide) contained in the air sucked from the first space 51. As the first gas sensor 20*g*, a sensor based on various principles can be adopted. Similarly to the second gas sensor 15*g*, the first gas sensor 20*g* of the example adopts a semiconductor gas sensor. The first gas sensor 20*g* exemplifies a first gas concentration measurer that measures the gas concentration of a predetermined gas contained in the air in the first space 51. The measurement results of these sensors are used as environmental information for controlling the operation of the ventilation system 100.

In the example of FIG. 4, the air conveyor 20 has one air exhaust port 21 and three air supply ports 22 provided on the first space 51 side. In addition, the air conveyor 20 includes a delivery port 23 communicating with the air conveyance path 40. The air exhaust port 21 is configured such that the conveyance flow 26 passes during the conveyance operation and the circulation flow 28 passes during the circulation operation. The air supply port 22 is configured to be closed during the conveyance operation and such that the circulation flow 28 passes during the circulation operation. The delivery port 23 is configured to be closed during the circulation operation and such that the conveyance flow 26 passes during the conveyance operation.

The air conveyor 20 of the example is configured to be remotely operable with a second remote controller 25 via a wired or wireless transmission path 20*s*. The second remote controller 25 is held on the wall surface 51*w* or the like of the first space 51. The second remote controller 25 is provided with a dust sensor 25*d* and a first illuminance sensor 25*j*. The dust sensor 25*d* measures the amount of house dust in the first space 51. The first illuminance sensor 25*j* measures the illuminance of the first space 51. The measurement results of these sensors are used as environmental information for controlling the operation of the ventilation system 100.

Air Conveyance Path

The air conveyance path 40 will be described. The air conveyance path 40 is a passage that communicates the first space 51 and the second space 52 and conveys the air from the first space 51 to the second space 52. The configuration of the air conveyance path 40 is not limited, but the air conveyance path 40 of the present example includes an air duct (air conduit). The air conveyance path 40 includes an inlet portion 40*j* communicated with the delivery port 23 of the air conveyor 20 and an outlet portion 40*e* opened to the ceiling surface 52*c* of the second space 52. The air conveyance path 40 allows the conveyance flow 26 delivered through the delivery port 23 during the conveyance operation to pass from the inlet portion 40*j* to the outlet portion 40*e* and supplies the conveyance flow 26 to the second space 52.

Controller

Figure 5:
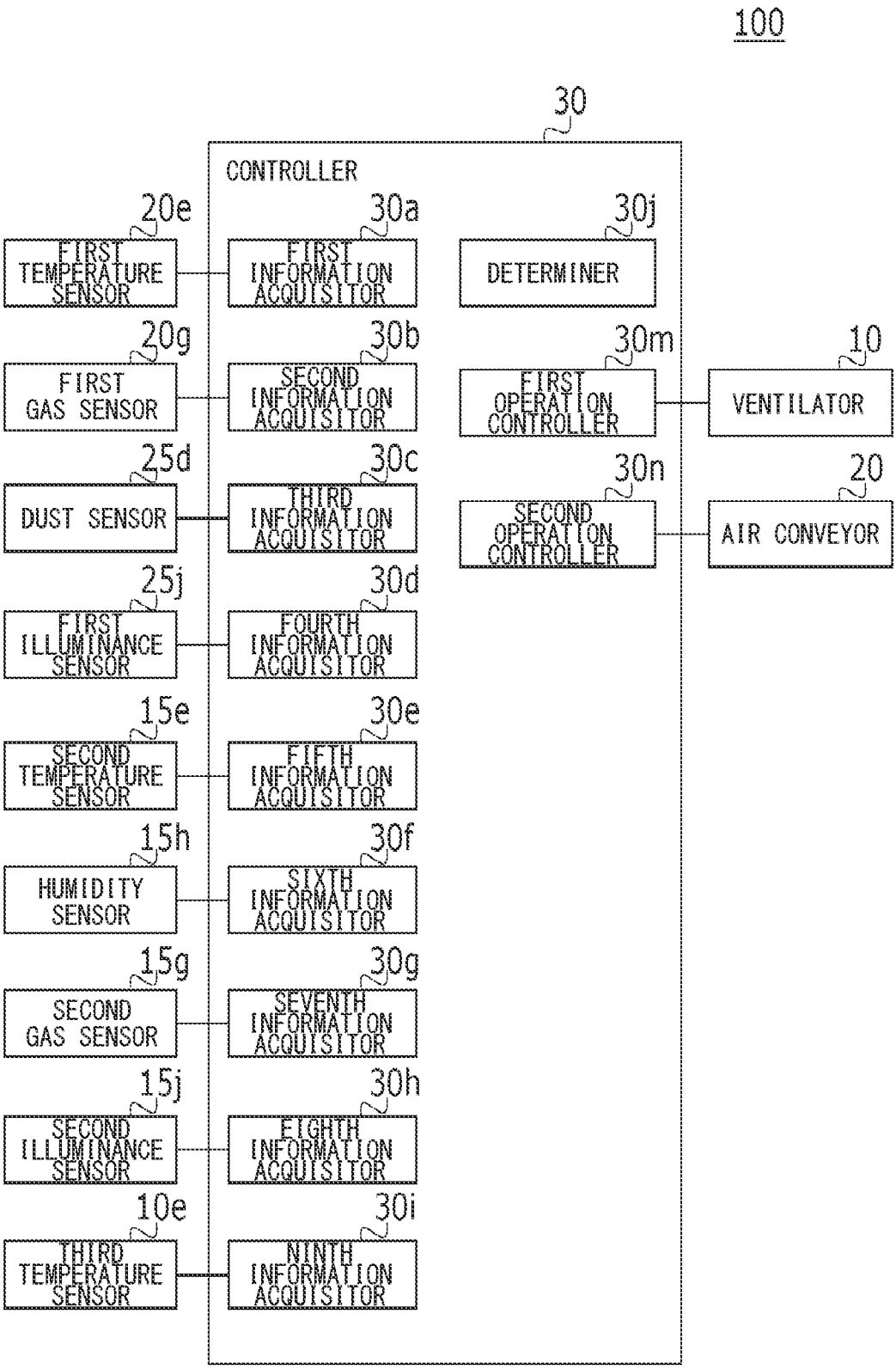
FIG. 5 is a block diagram schematically illustrating a controller of FIG. 1.

The controller 30 will be described with reference to FIG. 5. FIG. 5 is a block diagram schematically illustrating the controller 30. Each functional block illustrated in FIG. 5 can be realized by elements including a central processing unit (CPU) of a computer and a mechanical device in terms of hardware, and is realized by a computer program or the like in terms of software, but here, functional blocks realized by cooperation of these are illustrated. Therefore, it is understood by those skilled in the art who is aware of the present specification that these functional blocks can be realized in various forms by a combination of hardware and software.

As illustrated in FIG. 2, the controller 30 may be provided inside the ventilator 10 or the air conveyor 20, but is provided outside them in this example. The controller 30 transmits and receives environmental information and control information to and from the ventilator 10 and the air conveyor 20 via wired or wireless transmission paths 30*p* and 30*q*. The controller 30 includes a first information acquisitor 30*a*, a second information acquisitor 30*b*, a third information acquisitor 30*c*, a fourth information acquisitor 30*d*, a fifth information acquisitor 30*e*, a sixth information acquisitor 30*f*, a seventh information acquisitor 30*g*, an eighth information acquisitor 30*h*, a ninth information acquisitor 30*i*, a determiner 30*j*, a first operation controller 30*m*, and a second operation controller 30*n*.

The first information acquisitor 30*a* acquires a first temperature T1 of the first space 51 from the first temperature sensor 20*e*. The second information acquisitor 30*b* acquires a gas concentration of the first space 51 from the first gas sensor 20*g*. The third information acquisitor 30*c* acquires dust information of the first space 51 from the dust sensor 25*d*. The fourth information acquisitor 30*d* acquires illuminance of the first space 51 from the first illuminance sensor 25*j*. The fifth information acquisitor 30*e* acquires a second temperature T2 of the second space 52 from the second temperature sensor 15*e*.

The sixth information acquisitor 30*f* acquires humidity of the second space 52 from the humidity sensor 15*h*. The seventh information acquisitor 30*g* acquires a gas concentration of the second space 52 from the second gas sensor 15*g*. The eighth information acquisitor 30*h* acquires illuminance of the second space 52 from the second illuminance sensor 15*j*.

The ninth information acquisitor 30*i* acquires outside air temperature from the third temperature sensor 10*e*.

The determiner 30*j* determines that the air conveyance from the first space 51 to the second space 52 by the air conveyor 20 is possible or impossible. The first operation controller 30*m* controls the operation of the ventilator 10. The second operation controller 30*n* controls the operation of the air conveyor 20 according to the determination result of the determiner 30*j*.

An example of the operation of the ventilation system 100 configured as described above will be described. Each operation described below is started at a timing when the user performs a predetermined operation or at a preset timing. The user's operation may be performed via the first remote controller 15 or the second remote controller 25.

Figure 6:
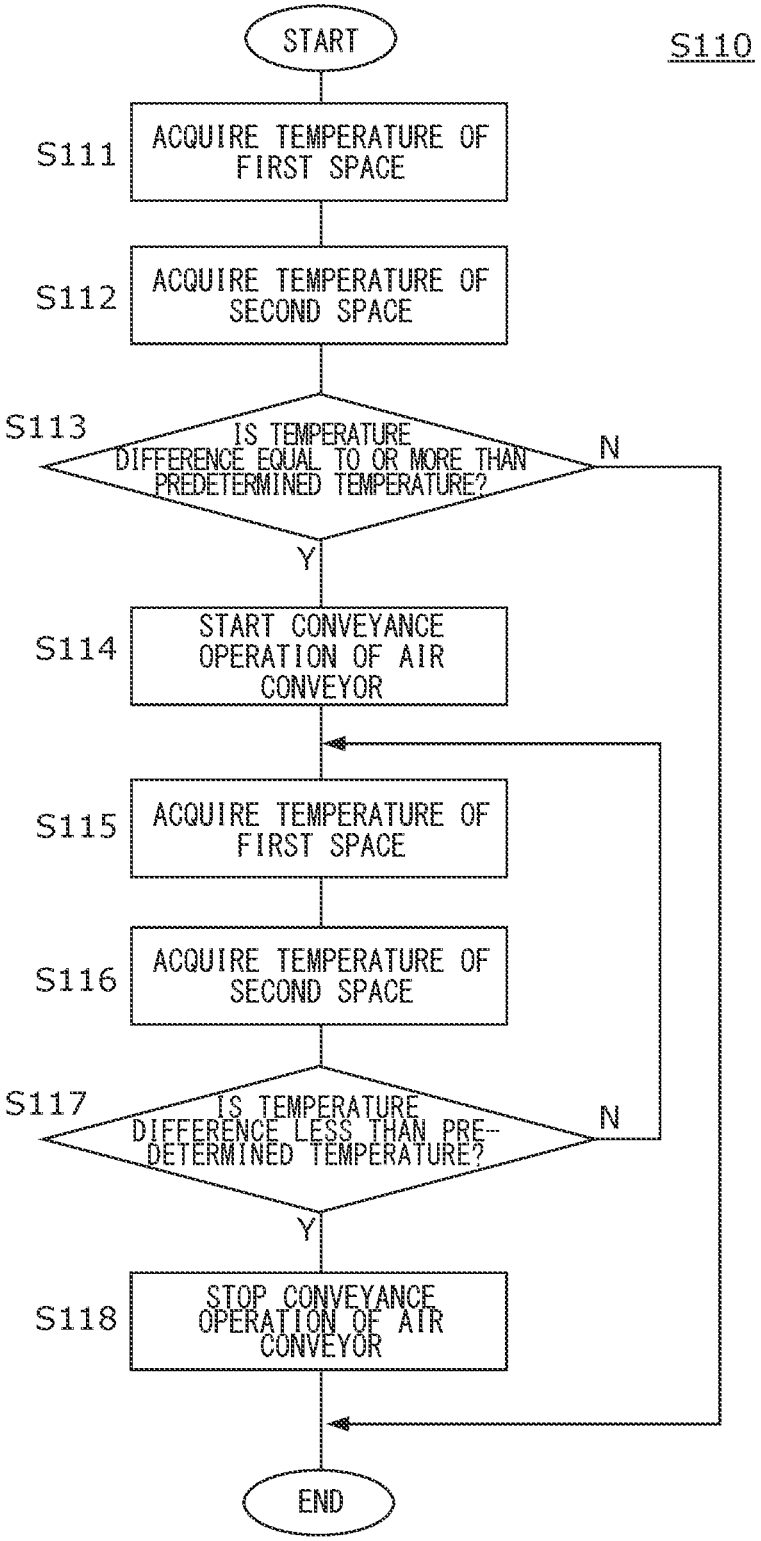
FIG. 6 is a flowchart illustrating a first operation of the ventilation system of FIG. 1.

First operation S110 of the ventilation system 100 will be described with reference to FIG. 6. FIG. 6 is a flowchart illustrating the first operation S110. The first operation S110 is an operation of controlling the air conveyor 20 on the basis of temperature difference. In the first operation S110, the determiner 30*j* determines that the air conveyance from the first space 51 to the second space 52 by the air conveyor 20 is possible when the air temperature difference between the first temperature T1 and the second temperature T2 exceeds a predetermined temperature.

When the first operation S110 is started, the controller 30 acquires the first temperature T1 of the first space 51 from the first temperature sensor 20e (step S111). Subsequently, the controller 30 acquires the second temperature T2 of the second space 52 from the second temperature sensor 15e (step S112).

Next, the determiner 30j determines whether or not the temperature difference between the first temperature T1 and the second temperature T2 is equal to or more than a predetermined temperature (for example, 3° C.) (step S113). When the temperature difference is less than the predetermined temperature (N in step S113), the controller 30 ends the first operation S110.

When the temperature difference is equal to or more than the predetermined temperature (Y in step S113), the controller 30 causes the air conveyor 20 to perform the conveyance operation to convey the air in the first space 51 to the second space 52 (step S114). For example, when the outside air temperature measured by the third temperature sensor 10e is 24° C. or more and (second temperature T2—first temperature T1) is 3° C. or more, the controller 30 may cause the air conveyor 20 to perform the conveyance operation. The air temperature of the second space 52 can be lowered in summertime. In addition, for example, when the outside air temperature measured by the third temperature sensor 10e is 16° C. or less and (first temperature T1—second temperature T2) is 3° C. or more, the controller 30 may cause the air conveyor 20 to perform the conveyance operation. The air temperature of the second space 52 can be increased in wintertime.

Next, the controller 30 acquires the first temperature T1 of the first space 51 from the first temperature sensor 20e (step S115). Subsequently, the controller 30 acquires the second temperature T2 of the second space 52 from the second temperature sensor 15e (step S116).

Next, the determiner 30j determines whether or not the temperature difference between the first temperature T1 and the second temperature T2 is less than a predetermined temperature (for example, 1° C.) (step S117). When the temperature difference is equal to or more than the predetermined temperature (N in step S117), the controller 30 returns to step S115 and repeats steps S115 to S117. When the temperature difference is less than the predetermined temperature (Y in step S117), the controller 30 stops the conveyance operation of the air conveyor 20 (step S118). In this step, the controller 30 may switch the air conveyor 20 to the circulation operation.

After step S118 is executed, the first operation S110 ends. Step S118 may be repeatedly executed. The predetermined temperature in the first operation S110 can be set by simulation or experiment according to a desired level of comfort.

Figure 7:
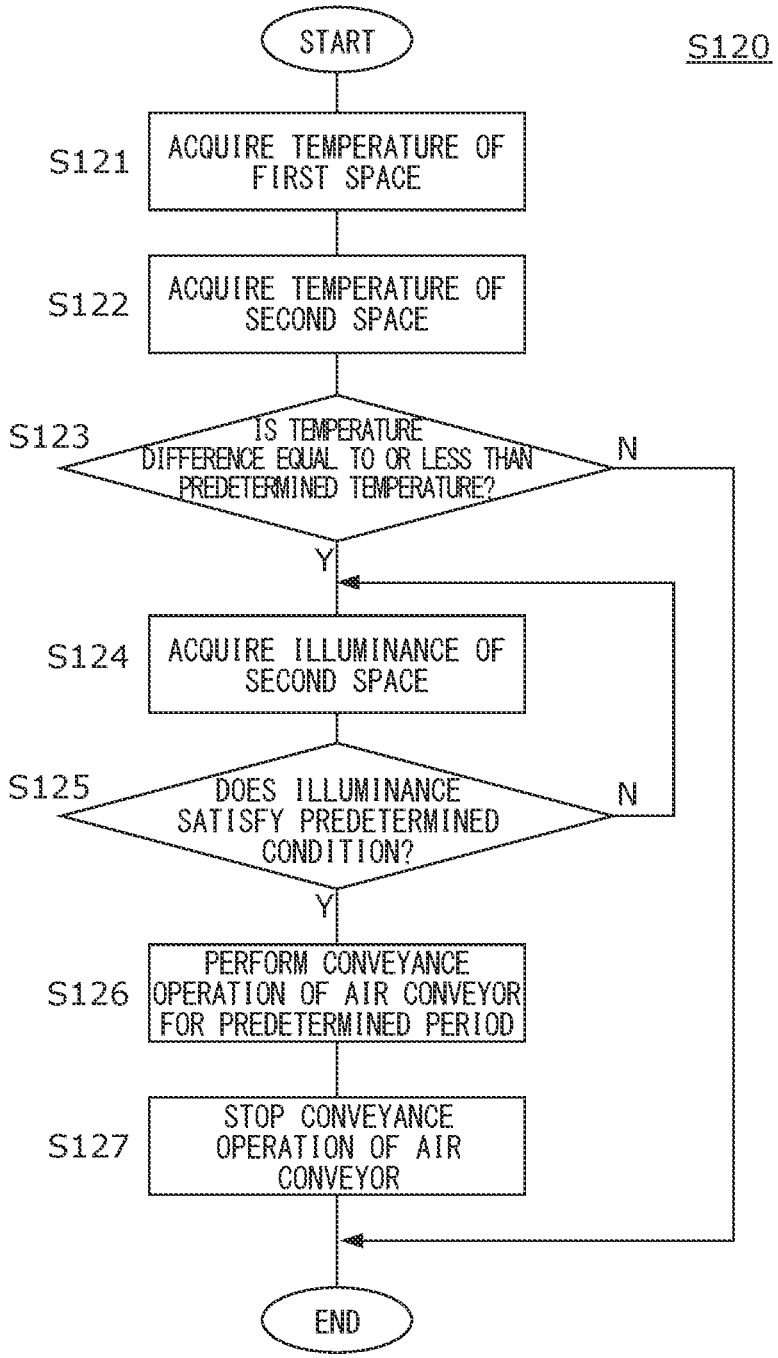
FIG. 7 is a flowchart illustrating a second operation of the ventilation system of FIG. 1.

Second operation S120 of the ventilation system 100 will be described with reference to FIG. 7. FIG. 7 is a flowchart illustrating the second operation S120. The second operation S120 is an operation of controlling the air conveyor 20 on the basis of a change in illuminance. In the second operation S120, the determiner 30j determines that the air conveyance from the first space 51 to the second space 52 by the air conveyor 20 is possible when the illuminance measured by the illuminance measurer (second illuminance sensor 15j) satisfies a predetermined condition.

When the second operation S120 is started, the controller 30 acquires the first temperature T1 of the first space 51 from the first temperature sensor 20e (step S121). Subsequently, the controller 30 acquires the second temperature T2 of the second space 52 from the second temperature sensor 15e (step S122).

Next, the determiner 30j determines whether or not the temperature difference between the first temperature T1 and the second temperature T2 is equal to or less than a predetermined temperature (for example, 7° C.) (step S123). This is to prevent cold air from being conveyed when the first space 51 (living room) is cold.

When the temperature difference exceeds the predetermined temperature (N in step S123), the controller 30 ends the second operation S120. When the temperature difference is equal to or less than the predetermined temperature (Y in step S123), the controller 30 acquires the illuminance of the second space 52 from the second illuminance sensor 15j (step S124).

Next, the determiner 30j determines whether or not the illuminance of the second space 52 satisfies a predetermined condition (step S125). As an example, when the illuminance of the second space 52 rapidly changes from a high state to a low state and 60 minutes have elapsed in that state, it may be determined that the illuminance satisfies the predetermined condition. As a result, it is possible to sense that the light of the second space 52 (bedroom) is turned off and the user goes to bed.

When the illuminance of the second space 52 does not satisfy the predetermined condition (N in step S125), the controller 30 returns to step S124 and repeats steps S124 to S125.

When the illuminance of the second space 52 satisfies the predetermined condition (Y in step S125), the controller 30 causes the air conveyor 20 to perform the conveyance operation and continues the state for a predetermined period (for example, 180 minutes) (step S126).

When the predetermined period has elapsed, the controller 30 stops the conveyance operation of the air conveyor 20 (step S127). In this step, the controller 30 may switch the air conveyor 20 to the circulation operation.

After step S127 is executed, the second operation S120 ends. The second operation S120 may be repeatedly executed. In addition, when the illuminance of the second space 52 rapidly changes from a low state to a high state in step S126, the controller 30 may stop the conveyance operation of the air conveyor 20. The predetermined temperature and the predetermined condition of illuminance in the second operation S120 can be set by simulation or experiment according to a desired level of comfort.

Figure 8:
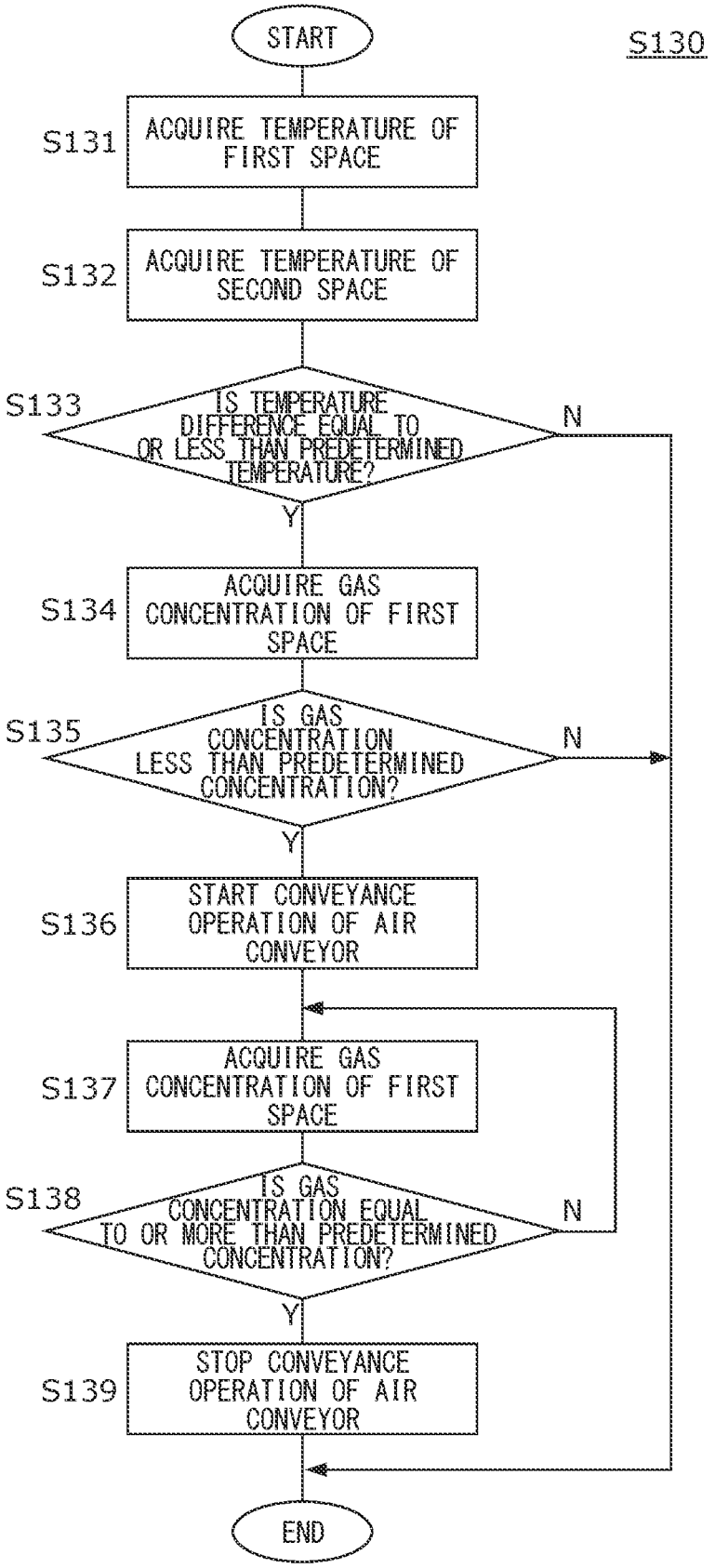
FIG. 8 is a flowchart illustrating a third operation of the ventilation system of FIG. 1.

Third operation S130 of the ventilation system 100 will be described with reference to FIG. 8. FIG. 8 is a flowchart illustrating the third operation S130. The third operation S130 is an operation of controlling the air conveyor 20 on the basis of gas concentration related to carbon dioxide, odor, and the like in the first space 51. In the third operation S130, when the gas concentration of the first space 51 measured by the first gas concentration measurer (first gas sensor 20g) is equal to or less than the predetermined concentration, the determiner 30j determines that the air conveyance from the first space 51 to the second space 52 by the air conveyor 20 is possible.

When the third operation S130 is started, the controller 30 acquires the first temperature T1 of the first space 51 from the first temperature sensor 20e (step S131). Subsequently, the controller 30 acquires the second temperature T2 of the second space 52 from the second temperature sensor 15e (step S132).

Next, the determiner 30j determines whether or not the temperature difference between the first temperature T1 and the second temperature T2 is equal to or less than a predetermined temperature (for example, 7° C.) (step S133). This is to prevent cold air from being conveyed when the first space 51 (living room) is cold.

When the temperature difference exceeds the predetermined temperature (N in step S133), the controller 30 ends the third operation S130. When the temperature difference is equal to or less than the predetermined temperature (Y in step S133), the controller 30 acquires the gas concentration of the first space 51 from the first gas sensor 20g (step S134).

Next, the determiner 30j determines whether or not the gas concentration of the first space 51 is less than the predetermined concentration (step S135). When the gas concentration of the first space 51 is equal to or more than the predetermined concentration (N in step S135), the controller 30 ends the third operation S130. That is, when the gas concentration of the first space 51 is high, the conveyance operation is not performed.

When the gas concentration of the first space 51 is less than the predetermined concentration (Y in step S135), the controller 30 causes the air conveyor 20 to perform the conveyance operation (step S136).

Next, the controller 30 acquires the gas concentration of the first space 51 from the first gas sensor 20g (step S137). Next, the determiner 30j determines whether or not the gas concentration of the first space 51 is equal to or more than the predetermined concentration (step S138). When the gas concentration of the first space 51 is less than the predetermined concentration (N in step S138), the controller 30 returns to step S137 and repeats steps S137 to S138.

When the gas concentration of the first space 51 is equal to or more than the predetermined concentration (Y in step S138), the controller 30 stops the conveyance operation of the air conveyor 20 (step S139). In this step, the controller 30 may switch the air conveyor 20 to the circulation operation. After step S139 is executed, the third operation S130 ends. The third operation S130 may be repeatedly executed. The predetermined temperature and the predetermined concentration of gas in the third operation S130 can be set by simulation or experiment according to a desired level of comfort.

Figure 9:
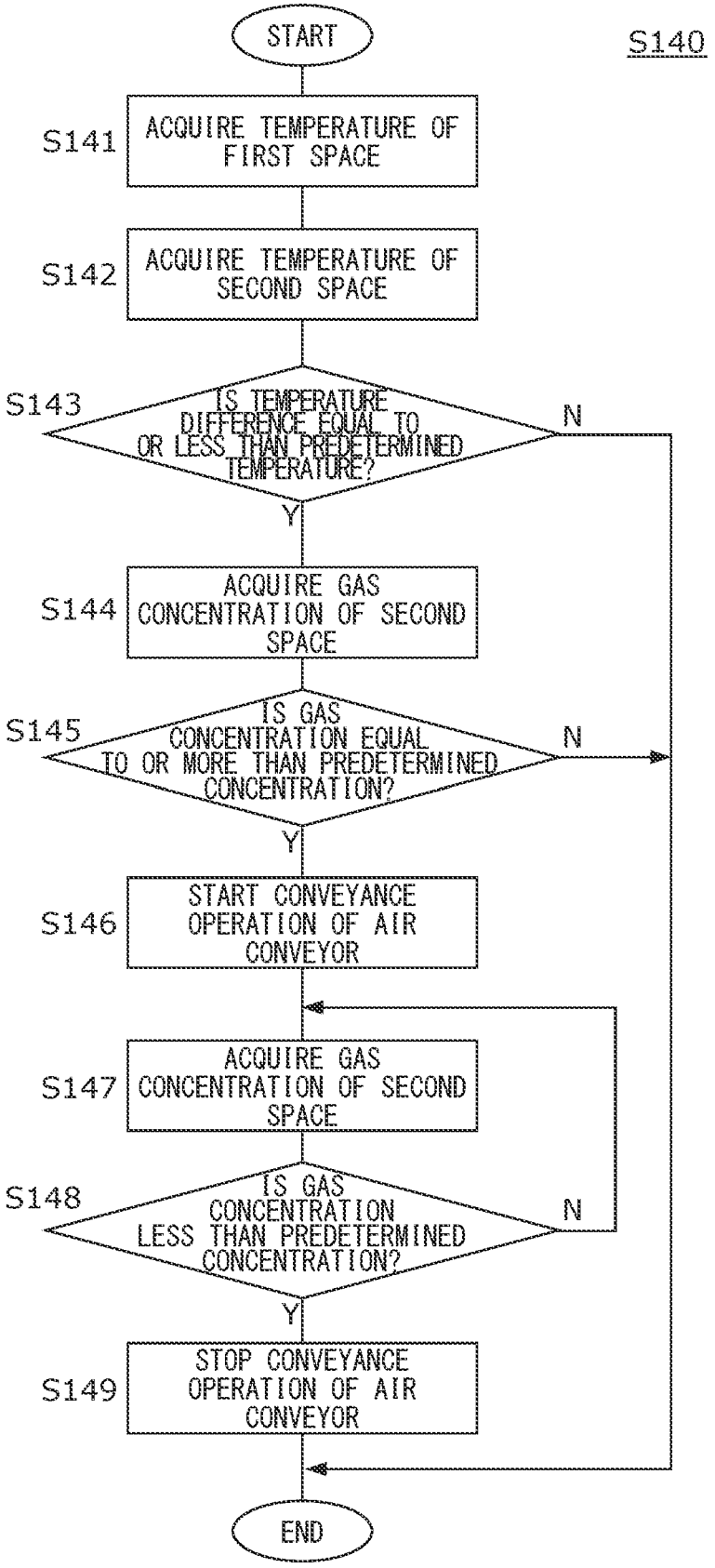
FIG. 9 is a flowchart illustrating a fourth operation of the ventilation system of FIG. 1.

Fourth operation S140 of the ventilation system 100 will be described with reference to FIG. 9. FIG. 9 is a flowchart illustrating the fourth operation S140. The fourth operation S140 is an operation of controlling the air conveyor 20 on the basis of gas concentration related to carbon dioxide, odor, and the like in the second space 52. In the fourth operation S140, when the gas concentration of the second space 52 measured by the second gas concentration measurer (second gas sensor 15g) is equal to or more than the predetermined concentration, the determiner 30j determines that the air conveyance from the first space 51 to the second space 52 by the air conveyor 20 is possible.

When the fourth operation S140 is started, the controller 30 acquires the first temperature T1 of the first space 51 from the first temperature sensor 20e (step S141). Subsequently, the controller 30 acquires the second temperature T2 of the second space 52 from the second temperature sensor 15e (step S142).

Next, the determiner 30j determines whether or not the temperature difference between the first temperature T1 and the second temperature T2 is equal to or less than a predetermined temperature (for example, 7° C.) (step S143). This is to prevent cold air from being conveyed when the first space 51 (living room) is cold.

When the temperature difference exceeds the predetermined temperature (N in step S143), the controller 30 ends the fourth operation S140. When the temperature difference is equal to or less than the predetermined temperature (Y in step S143), the controller 30 acquires the gas concentration of the second space 52 from the second gas sensor 15g (step S144).

Next, the determiner 30j determines whether or not the gas concentration of the second space 52 is equal to or more than the predetermined concentration (step S145). When the gas concentration of the second space 52 is less than the predetermined concentration (N in step S145), the controller 30 ends the fourth operation S140. That is, when the gas concentration of the second space 52 is low, the conveyance operation is not performed.

When the gas concentration of the second space 52 is equal to or more than the predetermined concentration (Y in step S145), the controller 30 causes the air conveyor 20 to perform the conveyance operation (step S146).

Next, the controller 30 acquires the gas concentration of the second space 52 from the first gas sensor 20g (step S147). Next, the determiner 30j determines whether or not the gas concentration of the second space 52 is less than the predetermined concentration (step S148). When the gas concentration of the second space 52 is equal to or more than the predetermined concentration (N in step S148), the controller 30 returns to step S147 and repeats steps S147 to S148.

When the gas concentration of the second space 52 is less than the predetermined concentration (Y in step S148), the controller 30 stops the conveyance operation of the air conveyor 20 (step S149). In this step, the controller 30 may switch the air conveyor 20 to the circulation operation. When the conveyance operation is stopped, the controller 30 ends the fourth operation S140. The fourth operation S140 may be repeatedly executed. The predetermined temperature and the predetermined concentration of gas in the fourth operation S140 can be set by simulation or experiment according to a desired level of comfort.

Figure 10:
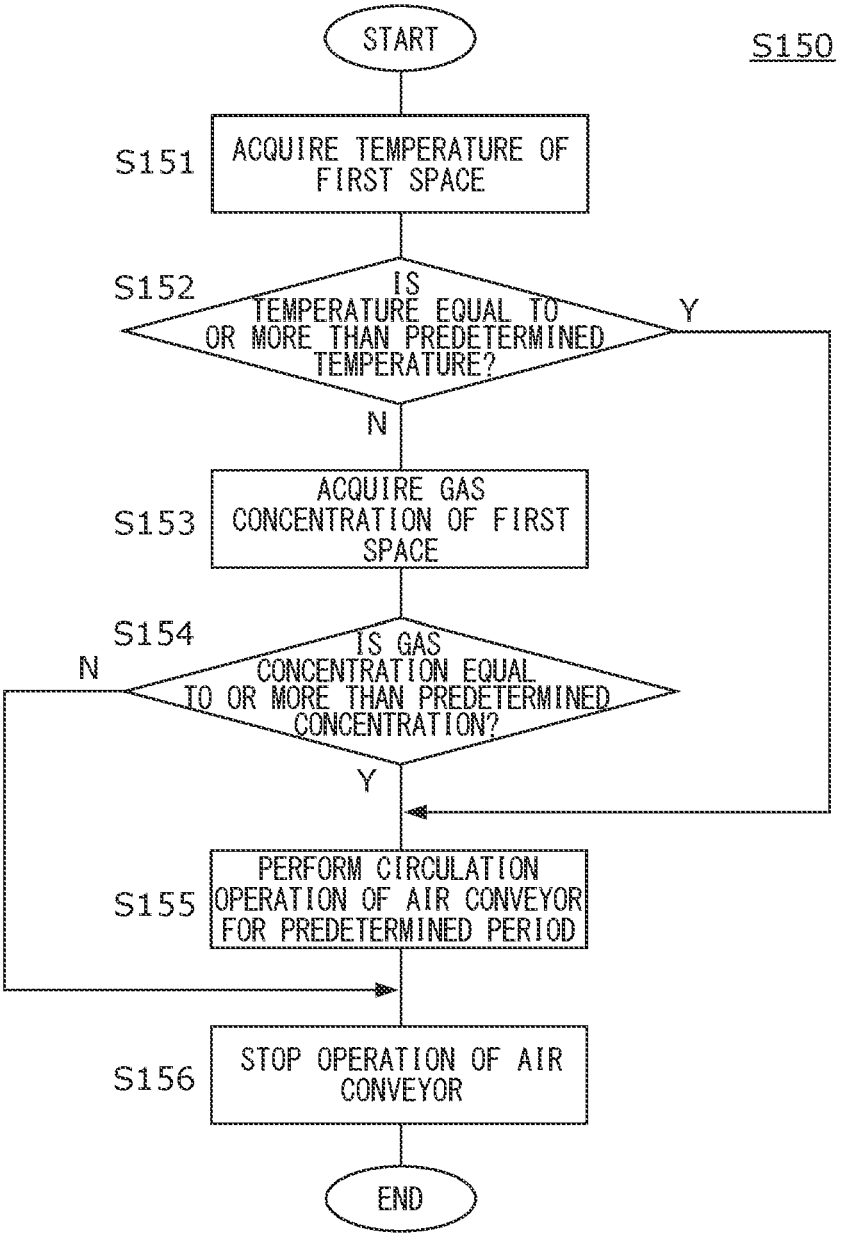
FIG. 10 is a flowchart illustrating a fifth operation of the ventilation system of FIG. 1.

Fifth operation S150 of the ventilation system 100 will be described with reference to FIG. 10. FIG. 10 is a flowchart illustrating the fifth operation S150. The fifth operation S150 is an operation of controlling the air conveyor 20 on the basis of the gas concentration or the air temperature of the first space 51.

When the fifth operation S150 is started, the controller 30 acquires the first temperature T1 of the first space 51 from the first temperature sensor 20e (step S151).

Next, the determiner 30j determines whether or not the first temperature T1 is equal to or more than a predetermined temperature (for example, 26° C.) (step S152). When the first temperature T1 is equal to or more than the predetermined temperature (Y in step S152), the controller 30 jumps to step S155 and causes the air conveyor 20 to perform the circulation operation for a predetermined period (for example, 180 minutes) (step S155). That is, the air conveyor 20 performs the circulation operation when the first temperature T1 is high.

When the first temperature T1 is less than the predetermined temperature (N in step S152), the controller 30 acquires the gas concentration of the first space 51 from the first gas sensor 20g (step S153).

Next, the determiner 30j determines whether or not the gas concentration of the first space 51 is equal to or more than the predetermined concentration (step S154). When the gas concentration of the first space 51 is equal to or more than the predetermined concentration (Y in step S154), the controller 30 causes the air conveyor 20 to perform the circulation operation for a predetermined period (for example, 180 minutes) (step S155). That is, the air conveyor 20 performs the circulation operation when the gas concentration of the first space 51 is high.

When the gas concentration of the first space 51 is less than the predetermined concentration (N in step S154) or the predetermined period of step S155 has elapsed, the controller 30 stops the operation of the air conveyor 20 (step S156). That is, the air conveyor 20 does not perform the circulation operation when the first temperature T1 is low or the gas concentration of the first space 51 is low. After step S156 is executed, the controller 30 ends the fifth operation S150. The fifth operation S150 may be repeatedly executed. The predetermined temperature and the predetermined concentration of gas in the fifth operation S150 can be set by simulation or experiment according to a desired level of comfort.

The first operation S110 to the fifth operation S150 described above are merely examples, and various modifications can be made. The first operation S110 to the fifth operation S150 may be executed in combination, or may be executed in combination with another operation.

Features of the ventilation system 100 will be described. According to the first operation S110, by suppressing the temperature difference between the first space 51 and the second space 52, the discomfort of the user moving between the first space 51 and the second space 52 can be alleviated. In addition, according to the second operation S120, the discomfort of the user sleeping in the second space 52 can be alleviated. In addition, according to the third operation S130 and the fourth operation S140, the clean air in the first space 51 can be conveyed to the second space 52, and the user's discomfort caused by the odor of the second space 52 or the like can be alleviated. In addition, according to the fifth operation S150, the air in the first space 51 can be cleaned to alleviate the user's discomfort caused by the odor or the air temperature of the first space 51.

An outline of one aspect of the present disclosure is as described below. A ventilation system (100) according to a certain aspect of the present disclosure includes: a ventilator (10) that ventilates a first space (51); an air conveyor (20) that is installed on a ceiling surface (51*c*) of the first space (51) and conveys air from the first space (51) to a second space (52) different from the first space (51); an air conveyance path (40) that communicates the first space (51) with the second space (52) and conveys air from the first space (51) to the second space (52); a controller (30) that controls an operation of the ventilator (10) and an operation of the air conveyor (20); a first temperature measurer (20*e*) that measures an air temperature of the first space (51); and a second temperature measurer (15*e*) that measures an air temperature of the second space (52). The air conveyor (20) includes a dust collector 29 for collecting dust contained in air passing through the air conveyance path (40). The ventilator (10) includes a heat exchange element (14) for performing heat exchange between a supply air flow (16) and an exhaust air flow (18). The controller (30) includes a determiner (30*j*) that determines whether air conveyance from the first space (51) to the second space (52) by the air conveyor (20) is possible or impossible on the basis of a first temperature (T1) measured by the first temperature measurer (20*e*) and a second temperature (T2) measured by the second temperature measurer (15*e*).

In the present example, the determiner (30*j*) determines that the air conveyance from the first space (51) to the second space (52) by the air conveyor (20) is possible when the air temperature difference between the first temperature (T1) and the second temperature (T2) exceeds a predetermined temperature.

The present example further includes an illuminance measurer (15*j*) that measures illuminance of the second space (52). The determiner (30*j*) determines that the air conveyance from the first space (51) to the second space (52) by the air conveyor (20) is possible when the illuminance measured by the illuminance measurer (15*j*) satisfies a predetermined condition.

In the present example, a first gas concentration measurer (20*g*) that measures the gas concentration of a predetermined gas contained in the air in the first space (51) is further included. The determiner (30*j*) determines that the air conveyance from the first space (51) to the second space (52) by the air conveyor (20) is possible when the gas concentration measured by the first gas concentration measurer (20*g*) is equal to or less than a predetermined concentration.

In the present example, a second gas concentration measurer (15*g*) that measures the gas concentration of a predetermined gas contained in the air in the second space (52) is further included. The determiner (30*j*) determines that the air conveyance from the first space (51) to the second space (52) by the air conveyor (20) is possible when the gas concentration of the second space (52) measured by the second gas concentration measurer (15*g*) is equal to or more than a predetermined concentration.

The present disclosure has been described above on the basis of the example. It is to be understood by those skilled in the art that the example is illustrative, various modifications can be made for a combination of components or processing processes, and such modifications are also within the scope of the present disclosure. In the aforementioned example, the contents that can be changed in design are described with notations such as "of the example" and "in the example", but it does not mean that the design change is not allowed for the contents without such notations.

Hereinafter, a modification will be described. In the drawings and description of the modification, the same or equivalent components and members as those of the example are denoted by the same reference numerals. The description overlapping with that of the example will be omitted as appropriate, and the configuration different from those of the example will be mainly described.

Modifications

In the description of the example, an example in which the first gas sensor 20*g* and the second gas sensor 15*g* measure the concentration of carbon dioxide has been described, but it is not limited thereto. The first gas sensor 20*g* and the second gas sensor 15*g* may measure the concentration of another type of gas such as formaldehyde.

The determiner 30*j* may determine that the air conveyance from the first space 51 to the second space 52 by the air conveyor 20 is possible or impossible, or may determine that the circulation operation is possible or impossible according to the amount of house dust in the first space 51 measured by the dust sensor 25*d*. In addition, the determiner 30*j* may determine that the air conveyance from the first space 51 to the second space 52 by the air conveyor 20 is possible or impossible according to the humidity of the second space 52 measured by the humidity sensor 15*h*.

These modifications provide operations and effects similar to those of the example.

INDUSTRIAL APPLICABILITY

The technology of the present disclosure can be used in a ventilation system capable of ventilating a plurality of spaces of a building.

REFERENCE SIGNS LIST

10 ventilator, 15*e* second temperature sensor, 15*g* second gas sensor, 15*h* humidity sensor, 15*j* second illuminance sensor, 20 air conveyor, 20*e* first temperature sensor, 20*g* first gas sensor, 14 heat exchange element, 25*d* dust sensor, 25*j* first illuminance sensor, 16 supply air flow, 18 exhaust air flow, 29 dust collector, 30 controller, 30*j* determiner, 40 air conveyance path, 51 first space, 51*c* ceiling surface, 52 second space, 100 ventilation system

The invention claimed is:

1. A ventilation system comprising:

a ventilator structured to ventilate a first indoor space located inside a building, the ventilator including a heat exchange element for performing heat exchange between a supply air flow and an exhaust air flow;

an air conveyance path structured to communicate the first indoor space and a second indoor space located inside the building different from the first indoor space and convey air from the first indoor space to the second indoor space;

an air conveyor installed on a ceiling surface of the first indoor space, the air conveyor being structured to include a dust collector for collecting dust contained in air passing through the air conveyance path and to convey, via the air conveyance path, air from the first indoor space to the second indoor space;

a controller structured to control i) an operation of the ventilator and ii) an operation of the air conveyor; and a first temperature measurer structured to measure an air temperature of the first indoor space and a second temperature measurer structured to measure an air temperature of the second indoor space, wherein the air conveyor includes a flow path switcher structured to switch between i) a conveyance operation of conveying the air from the first indoor space to the second indoor space through the air conveyance path and ii) a circulation operation of circulating air within the first indoor space, the controller includes a determiner structured to i) determine a temperature difference between the first temperature of the first indoor space and the second temperature of the second indoor space, and ii) determine whether to perform the conveyance operation of conveying the air from the first indoor space to the second indoor space when the temperature difference is equal to or more than a predetermined temperature or the circulation operation of circulating the air within the first indoor space when the temperature difference is less than the predetermined temperature, and the controller controls, based on the determination result of the determiner, the flow path switcher of the air conveyor to switch between i) the conveyance operation of conveying the air from the first indoor space through the flow path switcher and the air conveyance path to the second indoor space and ii) the circulation operation of circulating the air from the first indoor space through the flow path switcher and back to the first indoor space.

2. The ventilation system according to claim 1, further comprising an illuminance measurer structured to measure illuminance of the second indoor space, wherein the determiner determines to perform i) the conveyance operation when the illuminance measured by the illuminance measurer satisfies a predetermined condition and ii) the circulation operation when a predetermined period has elapsed since execution of the conveyance operation.

3. The ventilation system according to claim 1, further comprising a first gas concentration measurer structured to measure a gas concentration of a predetermined gas contained in the air in the first indoor space, wherein the determiner determines to perform i) the conveyance operation when the gas concentration measured by the first gas concentration measurer is less than a predetermined concentration and ii) the circulation operation when the gas concentration measured by the first gas concentration measurer is equal to or more than the predetermined concentration.

4. The ventilation system according to claim 2, further comprising a first gas concentration measurer structured to measure a gas concentration of a predetermined gas contained in the air in the first indoor space, wherein the determiner determines to perform i) the conveyance operation when the gas concentration measured by the first gas concentration measurer is less than a predetermined concentration and ii) the circulation operation when the gas concentration measured by the first gas concentration measurer is equal to or more than the predetermined concentration.

5. The ventilation system according to claim 1, further comprising a second gas concentration measurer structured to measure a gas concentration of a predetermined gas contained in the air in the second indoor space, wherein the determiner determines to perform i) the conveyance operation when the gas concentration measured by the second gas concentration measurer is equal to or more than a predetermined concentration and ii) circulation operation when the gas concentration measured by the second gas concentration measurer is less than the predetermined concentration.

6. The ventilation system according to claim 2, further comprising a second gas concentration measurer structured to measure a gas concentration of a predetermined gas contained in the air in the second indoor space, wherein the determiner determines to perform i) the conveyance operation when the gas concentration measured by the second gas concentration measurer is equal to or more than a predetermined concentration and ii) the circulation operation when the gas concentration measured by the second gas concentration measurer is less than the predetermined concentration.

7. The ventilation system according to claim 3, further comprising a second gas concentration measurer structured to measure a gas concentration of a predetermined gas contained in the air in the second indoor space, wherein the determiner determines to perform i) the conveyance operation when the gas concentration measured by the second gas concentration measurer is equal to or more than a predetermined concentration and ii) the circulation operation when the gas concentration measured by the second gas concentration measurer is less than the predetermined concentration.

8. The ventilation system according to claim 4, further comprising a second gas concentration measurer structured to measure a gas concentration of a predetermined gas contained in the air in the second indoor space, wherein the determiner determines to perform i) the conveyance operation when the gas concentration measured by the second gas concentration measurer is equal to or more than a predetermined concentration and ii) the circulation operation when the gas concentration measured by the second gas concentration measurer is less than the predetermined concentration.

9. A building equipped with the ventilation system according to claim 1.

* * * * *